US007717296B1

(12) United States Patent
Guthrie

(10) Patent No.: US 7,717,296 B1
(45) Date of Patent: May 18, 2010

(54) TRANSPORTABLE AND COLLAPSIBLE FABRIC TANK SYSTEM WITH INTEGRAL BALLOON BAFFLE SYSTEM

(76) Inventor: Jarred W. Guthrie, 333 Baronne St., Unit H, New Orleans, LA (US) 70112

( * ) Notice: Subject to any disclaimer, the term of this patent is extended or adjusted under 35 U.S.C. 154(b) by 500 days.

(21) Appl. No.: 11/821,359

(22) Filed: Jun. 22, 2007

Related U.S. Application Data

(60) Provisional application No. 60/815,385, filed on Jun. 22, 2006.

(51) Int. Cl.
*B65D 35/56* (2006.01)

(52) U.S. Cl. ..... 222/105; 220/563

(58) Field of Classification Search ..... 222/92–107; 220/560.08, 560.11, 562–564, 1.5
See application file for complete search history.

(56) References Cited

U.S. PATENT DOCUMENTS

| | | | | | |
|---|---|---|---|---|---|
| 2,724,418 | A | * | 11/1955 | Krupp | 220/565 |
| 2,997,973 | A | | 8/1961 | Hawthorne et al. | |
| 3,067,712 | A | | 12/1962 | Doerpinghaus | |
| 3,282,361 | A | * | 11/1966 | Mackie | 180/124 |
| 3,416,762 | A | * | 12/1968 | Headrick | 410/85 |
| 3,510,142 | A | * | 5/1970 | Erke | 280/837 |
| 3,604,719 | A | * | 9/1971 | Kerr | 280/839 |
| 4,132,310 | A | * | 1/1979 | Dorsch | 206/386 |
| 4,484,533 | A | | 11/1984 | David | |
| 4,573,508 | A | * | 3/1986 | Knaus | 220/562 |
| 4,865,096 | A | * | 9/1989 | Schober et al. | 383/107 |
| 4,875,596 | A | * | 10/1989 | Lohse | 220/1.6 |
| 4,881,665 | A | | 11/1989 | Jansky et al. | |
| 5,203,272 | A | | 4/1993 | Kassinger et al. | |
| 5,257,893 | A | | 11/1993 | Sevits | |
| 5,524,781 | A | * | 6/1996 | Podd et al. | 220/1.5 |
| 5,722,552 | A | | 3/1998 | Olson | |
| 6,186,713 | B1 | * | 2/2001 | Bonerb | 410/100 |
| 6,718,896 | B2 | | 4/2004 | Davenport | |
| 6,842,955 | B2 | * | 1/2005 | Joshi et al. | 29/407.01 |
| 6,860,218 | B2 | | 3/2005 | Eagles et al. | |
| 2007/0181583 | A1 | * | 8/2007 | Zacharias | 220/563 |

* cited by examiner

*Primary Examiner*—Lien T Ngo
(74) *Attorney, Agent, or Firm*—Robert B. Montgomery

(57) ABSTRACT

A portable, flexible, fabric-composite-based, tank system with internal baffles capable for transporting water and other liquids on a non-dedicated truck is herein disclosed. A heavy textile tank is impregnated with a polytetrafluoroethylene (PTFE) is available in multiple sizes capable of being transported by pickup, flatbed or tractor-trailer trucks. The fabric tank have a series of internal inflatable baffles to aid in the stability of the tank by preventing sloshing of the liquid contents while traveling with the tank partially filled. The internal baffles inflate to sizes large enough to force liquids out of the tank through the discharge valve by displacing fluid with air without the need for a pump. When finished with use, the fabric tanks can be cleaned, dried, and collapsed for storage, thus allowing the truck's transport platform to be used for other tasks if necessary.

20 Claims, 6 Drawing Sheets

TRANSPORTABLE AND COLLAPSIBLE FABRIC TANK SYSTEM WITH INTEGRAL BALLOON BAFFLE SYSTEM

RELATED APPLICATIONS

The present invention was first described in and claims the benefit of U.S. Provisional Application No. 60/815,385, filed Jun. 22, 2006, the entire disclosures of which are incorporated herein by reference.

FIELD OF THE INVENTION

The present invention relates generally to a large portable, flexible, fabric-composite based, tank and method of use and, more particularly, to a fluid containment apparatus comprised of internal baffles capable for transporting water or other liquids on virtually any sized truck.

BACKGROUND OF THE INVENTION

There are many areas of the world that are not provided with drinkable water by a centralized piping distribution system. In such cases, water is typically provided by tanker truck. The tanker truck is capable of delivering large quantities of water, or other liquids, where and when needed. However, the tanker truck has disadvantages. First, it is a dedicated vehicle, and as such is not suited for other uses when not serving as a liquid delivery vehicle. Second, when not in use, it requires considerable storage space. Third, it can be dangerous to transport a partially filled tank due to the effect sloshing liquid has on vehicle dynamics in panic or emergency driving situations. A final disadvantage is when removing the liquid from a tanker, a discharge pump is usually required to dispense the contained fluids. There does not exist an apparatus that addresses and solves the disadvantages as herein described. Accordingly, there is a need for a means by which large quantities of liquid can be transported without the disadvantages as listed above. The development of this invention fulfills these needs.

SUMMARY OF THE INVENTION

In view of the foregoing disadvantages inherent in the prior art, it has been observed that there is need for a portable, flexible and transportable tank system providing an efficient means of distributing water and/or other liquids.

The invention is a portable, flexible, fabric-composite based, tank having inflatable, internal baffles capable of transporting liquids such as water or other liquids on a flatbed truck, wherein said baffles provide stability of said tank and prevent the sloshing of said liquids.

When in a deflated configuration and laid flat, said portable, flexible and transportable tank system is approximately 28' long by 7'4" wide by 4" high. When in a fully filled configuration, it assumes a pillow-like shape approximately 27' long by 5'2" wide by 4'6" high and is capable of holding approximately 3,000 gallons.

The invention further comprises a clamp top further comprising a set of hand grips to aid in movement and placement of the portable, flexible and transportable tank system when empty and a clamp bottom. Said clamp top and clamp bottom further comprise a left hand top end clamp, a left hand bottom end clamp, a right hand top end clamp, and a right hand bottom end clamp. Fastening of said clamp top and clamp bottom is aided by a plurality of fastening elements, such as cap screws and flat washers.

Located within an interior of the portable, flexible and transportable tank system is at least one balloon baffle capable of inflation with air pressure via an external pump through at least one series of three independent balloon baffle air valves. Preferably, the invention comprises a three (3) balloon baffles inflated via three (3) air valves. Said balloon baffle(s) provide said portable, flexible and transportable tank system with its overall shape and aids in the stability of the tank. Also said pressurization forces liquids out of the portable, flexible and transportable tank system therethrough a gate valve assembly as the balloon baffle(s) are inflated. The action of inflating the baffles results in forcing the liquids within the tank outward through distribution piping without the need for an auxiliary internal or external pumping system.

A gate valve assembly is located at a first end of said portable, flexible and transportable tank system, and comprises an inside flange face and an inlet end, a rubber adapter placed between said portable, flexible and transportable tank system and said inside flange face and functions as a gasket. A pipe clamp is then placed around said first end of said portable, flexible and transportable tank system and tightened to provide a mechanical and watertight seal. A hose adapter is provided at an outlet end of said gate valve assembly to allow said gate valve assembly to connect to external distribution piping. The gate valve assembly preferably comprises a 4" gate valve, though virtually any type of valve could be used with equal effectiveness.

Said gate valve assembly further comprises a pressure gage assembly, affixed thereto said gate valve assembly, said pressure gage assembly further comprises a isolation valve, a water pressure gage, and associated piping and fittings.

Further, it is envisioned that the portable, flexible and transportable tank system would be supplied with at least two (2) lengths of hose, preferably ten (10) feet in length with quick connect fittings in a conventional arrangement.

Further, an inlet and an outlet connector each in fluid connection therewith external distribution piping at second ends and thereto said portable, flexible and transportable tank system at first ends are provided.

The invention further utilizes such a tank comprising a heavy textile-based bladder either coated thereon or impregnated therewith a flexible material, such as PTFE.

Additionally, a relief valve provides a means to bleed off vapors attachable thereto said tank; wherein said relief valve further provides stabilization during transportation, when said tank is partially filled.

Also, further safety features for the present invention comprise a series of four (4) tie-down harnesses for preventing the portable, flexible and transportable tank system from lateral movement during transportation. The tie-down harnesses may further comprise a ratcheting mechanism. A protective bed cloth protects the portable, flexible and transportable tank from any physical abnormalities present on the bed of a towing vehicle, thereby helping to avoid possible puncture. A plurality of identification labels may be removably affixed thereto an external surface of said portable, flexible and transportable tank system.

Further, the tank is adaptable to a variety of capable of being attached thereto a towing vehicle, such as pick-up trucks or tractor-trailers. When finished with use, the fabric bladder tank can be cleaned, dried, and collapsed for storage within a sling, thus allowing the truck to return to other duties.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
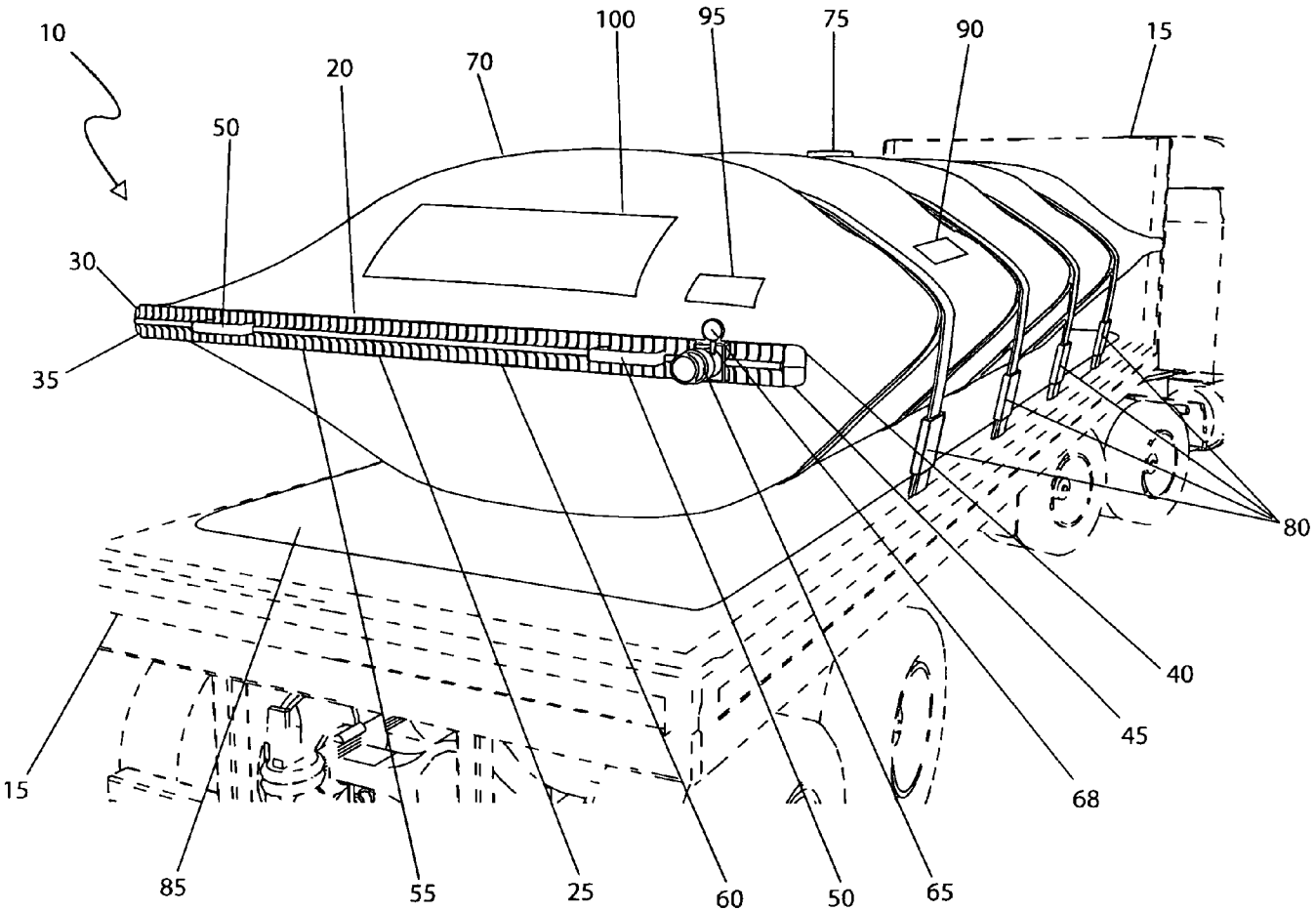
FIG. 1 is an isometric view of the transportable and collapsible fabric tank system with integral balloon baffle system 10, according to the preferred embodiment of the present invention.

| | |
|---|---|
| 10 | transportable and collapsible fabric tank system with integral baffle system |
| 15 | truck transport system |
| 20 | clamp top |
| 25 | clamp bottom |
| 30 | left hand top end clamp |
| 35 | left hand bottom end clamp |
| 40 | right hand top end clamp |
| 45 | right hand bottom end clamp |
| 50 | hand grip |
| 55 | flat washers |
| 60 | cap screws |
| 65 | gate valve assembly |
| 68 | pressure gage assembly |
| 69 | pressure gauge |
| 70 | tank material |
| 75 | pressure relief valve |
| 80 | tie-down harnesses |
| 85 | protective bed cloth |
| 90 | first identification label |
| 95 | second identification label |
| 100 | third identification label |
| 105 | balloon baffles |
| 110 | balloon baffle air valves |
| 115 | sling |
| 120 | belts |
| 125 | ratchet take-up mechanisms |
| 130 | elbow |
| 135 | isolation valve |
| 140 | pipe nipple |
| 145 | rubber adapter |
| 150 | inside flange face |
| 155 | pipe clamp |
| 160 | hose adapter |
| 165 | gate valve |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a transportable and collapsible fabric tank system with integral balloon baffle system 10 comprising a large portable, flexible, fabric-composite based, fluid tank system 10 with internal inflatable baffles 105 capable of transporting water and other liquids on a truck 15. In lieu of a steel tank, the invention 10 utilizes a heavy fabric-based tank 70, which is impregnated and coated with a flexible polytetrafluoroethylene (PTFE) material (such as Teflon®). The tank 70 would be available in multiple sizes suitable for transport using pickup trucks 15 up to tractor-trailer rigs 15. The series of internal balloon baffles 105 aids in the stability of the tank 70, as well as preventing sloshing of the liquid contents while traveling with the tank 70 partially filled. The invention 10 would reduce or eliminate the need for pumps dependent on pressure and flow rates. When finished with use, the transportable and collapsible fabric tank system with integral balloon baffle system 10 can be cleaned, dried, and collapsed or folded for storage, thus allowing the truck's transport platform 15 to be used for other tasks if necessary. The use of the present invention 10 provides a means of distributing water, fuel, and other liquids to remote locations.

Referring now to FIG. 1, an isometric view of the transportable and collapsible fabric tank system with integral balloon baffle system 10, according to the preferred embodiment of the present invention is disclosed. The transportable and collapsible fabric tank system with integral balloon baffle system 10 is shown setting upon a truck transport system 15, herein depicted as a flatbed trailer commonly used with an over the road tractor trailer rig, and is described as such in detailed descriptions hereinbelow. However, by scaling various parameters of the transportable and collapsible fabric tank systems with integral balloon baffle system 10, it can be used with small truck transport system 15, such as pickup trucks, and as such, should not be interpreted as a limiting factor of the present invention. Access to the interior of the transportable and collapsible fabric tank system with integral balloon baffle system 10 is provided through the use of a clamp top 20 and a clamp bottom 25. The clamp top 20 and the clamp bottom 25 consist of a left hand top end clamp 30 and a left hand bottom end clamp 35, and a right hand top end clamp 40 and a right hand bottom end clamp 45. A set of hand grips 50 are provided along the clamp top 20 to aid in movement and placement of the transportable and collapsible fabric tank system with integral balloon baffle system 10 when empty. Fastening of the clamp top 20 and clamp bottom 25 is aided by a plurality of cap screws 60 and flat washers 55. A gate valve assembly 65 is located at one end of the transportable and collapsible fabric tank system with integral balloon baffle system 10 and will be described in greater detail herein below. A pressure gage assembly 68 is provided as part of the gate valve assembly 65. When laid flat the transportable and collapsible fabric tank system with integral balloon baffle system 10 is approximately 28' long by 7'4" wide by 4" high. When filled it assumes a pillow like shape approximately 27' long by 5'2" wide by 4'6" high. When tilled the transportable and collapsible fabric tank system with integral balloon baffle system 10 is capable of holding approximately 3,000 gallons. The tank material 70 is made of a polytetrafluoroethylene (PTFE)-coated or—impregnated material, an example of which includes Teflon® which increases durability and allows for the transportation of liquids such as fuel, water, and other fluids. A pressure relief valve 75 prevents over pressurization of the transportable and collapsible fabric tank system with integral balloon baffle system 10 and possible rupture. A series of four (4) tie-down harnesses 80 prevents the transportable and collapsible fabric tank system with integral balloon baffle system 10 from lateral movement during transportation. Finally, a protective bed cloth 85 protects the tank material 70 from any physical abnormalities present on the bed of the truck transport system 15, thereby helping to avoid possible puncture. It is also envisioned that the transportable and collapsible fabric tank system with integral balloon baffle system 10 would be provided with an emergency repair kit (not shown) which would include common temporary repair items, such as plugs and clamps, to institute an emergency repair, should the transportable and collapsible fabric tank system with integral balloon baffle system 10 become punctured.

A first identification label 90, a second identification label 95 and a third identification label 100 provide relevant information such as tank contents, pressure limitations, transport limitations, torque limitations and the like.

Figure 2:
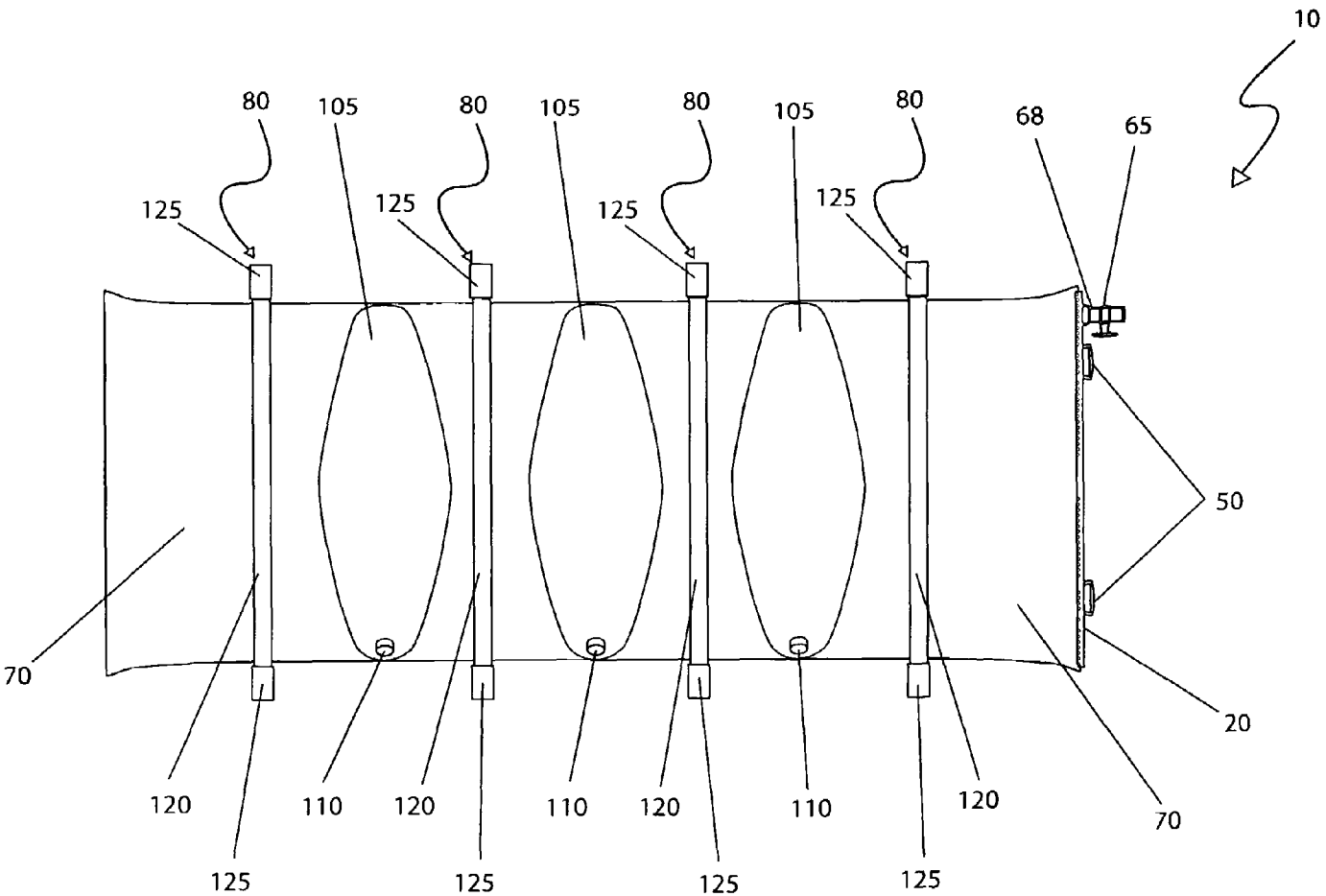
FIG. 2 is a cut-away view depicting an interior portion of the transportable and collapsible fabric tank system with integral balloon baffle system 10, as seen in FIG. 1, according to the preferred embodiment of the present invention.

Referring next to FIG. 2, a cut-away view depicting an interior portion of the transportable and collapsible fabric tank system with integral balloon baffle system 10, according to the preferred embodiment of the present invention is disclosed. Said FIG. more clearly illustrates the placement of the four (4) tie-down harnesses 80, and the protective bed cloth 85 upon the truck transport system 15. This FIG. clearly depicts the hand grip 50, the gate valve assembly 65, and the pressure gage assembly 68 as well. Located on the interior of the transportable and collapsible fabric tank system with integral balloon baffle system 10 is a series of three (3) balloon baffles 105 which are inflated with air pressure via a series of three independent balloon baffle air valves 110. Said balloon baffles 105 provide the transportable and collapsible fabric tank system with integral balloon baffle system 10 with its overall shape and aids in the stability of the tank. Also said pressurization aids in emptying the transportable and collapsible fabric tank system with integral balloon baffle system 10 by forcing fluids out of the tank 70 through the gate valve assembly 65 as the balloon baffles 105 are inflated.

Figure 3B:
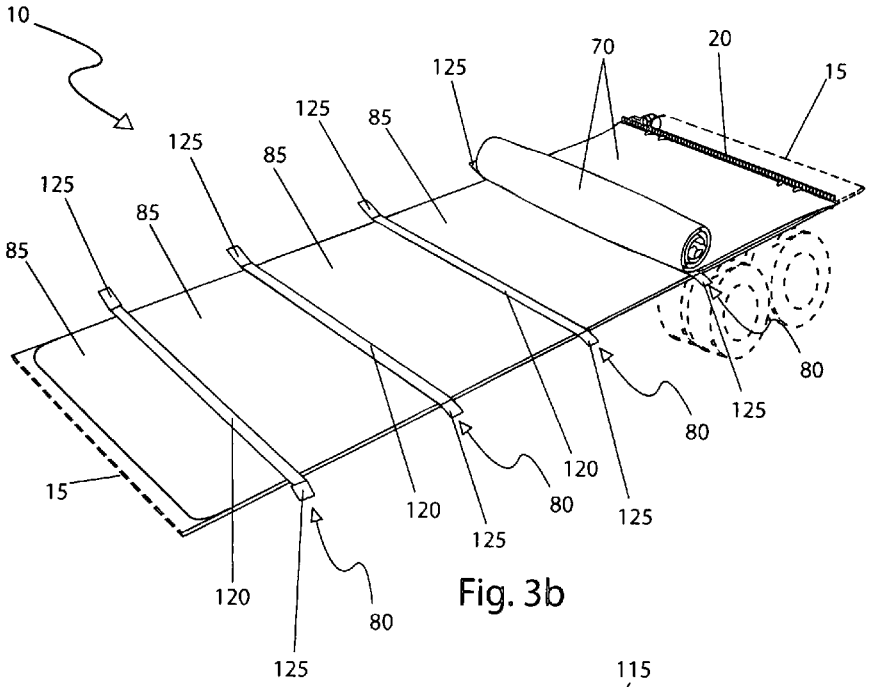
FIG. 3*b* is an isometric view of the transportable and collapsible fabric tank system with integral balloon baffle system 10 in a partially deployed state.
Figure 3A:
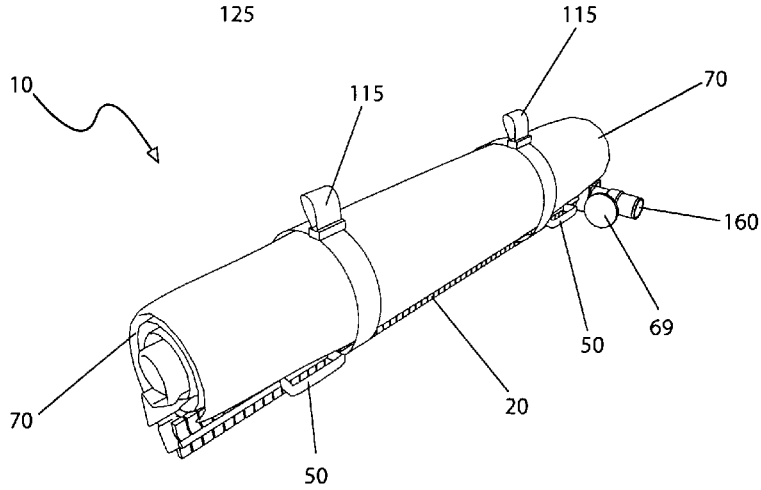
FIG. 3*a* is an isometric view of the transportable and collapsible fabric tank system with integral balloon baffle system 10 in a rolled up or stored state.

Referring now to FIG. 3*a*, an isometric view of the transportable and collapsible fabric tank system with integral balloon baffle system 10 in a rolled up or stored state is shown. When not in use, the transportable and collapsible fabric tank system with integral balloon baffle system 10 may be folded and rolled and stored in a sling 115. Said sling 115 is necessary to lift the weight of the transportable and collapsible fabric tank system with integral balloon baffle system 10, and can be facilitated by the use of a crane, forklift or other mechanical aid.

Referring next to FIG. 3*b*, an isometric view of the transportable and collapsible fabric tank system with integral balloon baffle system 10 in a partially deployed state is depicted. This FIG. clearly depicts the four (4) tie-down harnesses 80 and their associated placement at regular intervals along the length of the transportable and collapsible fabric tank system with integral balloon baffle system 10. Each tie-down harness 80 comprises a pair of ratchet take-up mechanisms 125, and trailer attachments specifically designed to minimize tank 70 movement during transport.

Figure 3D:
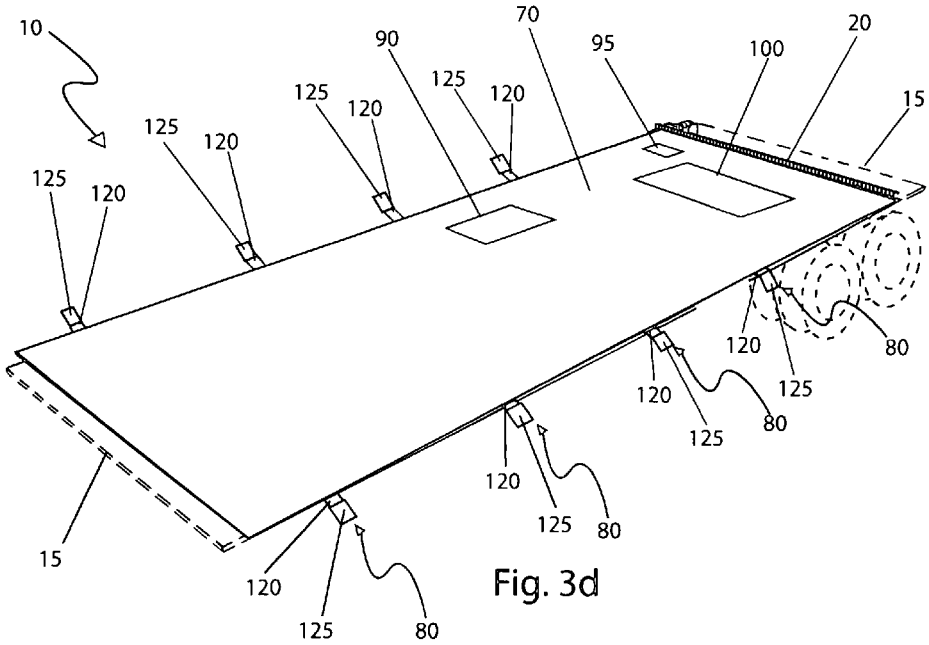
FIG. 3*c* is an isometric view of the transportable and collapsible fabric tank system with integral balloon baffle system 10 in a further deployed state; and, FIG. 3*d* is an isometric view of the transportable and collapsible fabric tank system with integral balloon baffle system 10 in a fully deployed state.
Figure 3C:
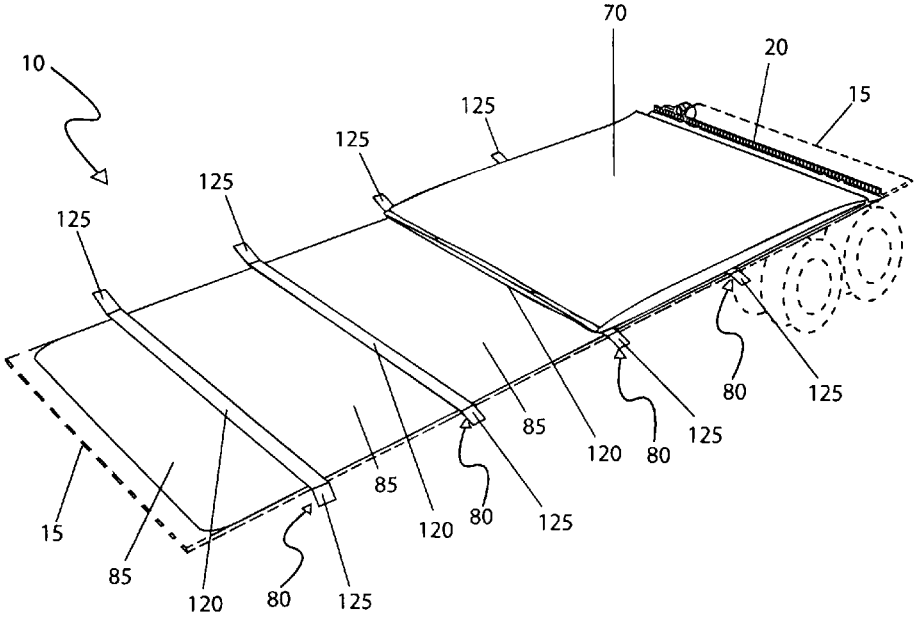

Referring now to FIG. 3*c*, an isometric view of the transportable and collapsible fabric tank system with integral balloon baffle system 10 in a further deployed state is disclosed. At this point the transportable and collapsible fabric tank system with integral balloon baffle system 10 is unrolled, but is still folded in half.

Referring next to FIG. 3*d*, an isometric view of the transportable and collapsible fabric tank system with integral balloon baffle system 10 in a fully deployed state is shown. At this point in time, the transportable and collapsible fabric tank system with integral balloon baffle system 10 is completely flat with the gate valve assembly 65 located at the rear of the truck transport system 15.

Figure 4:
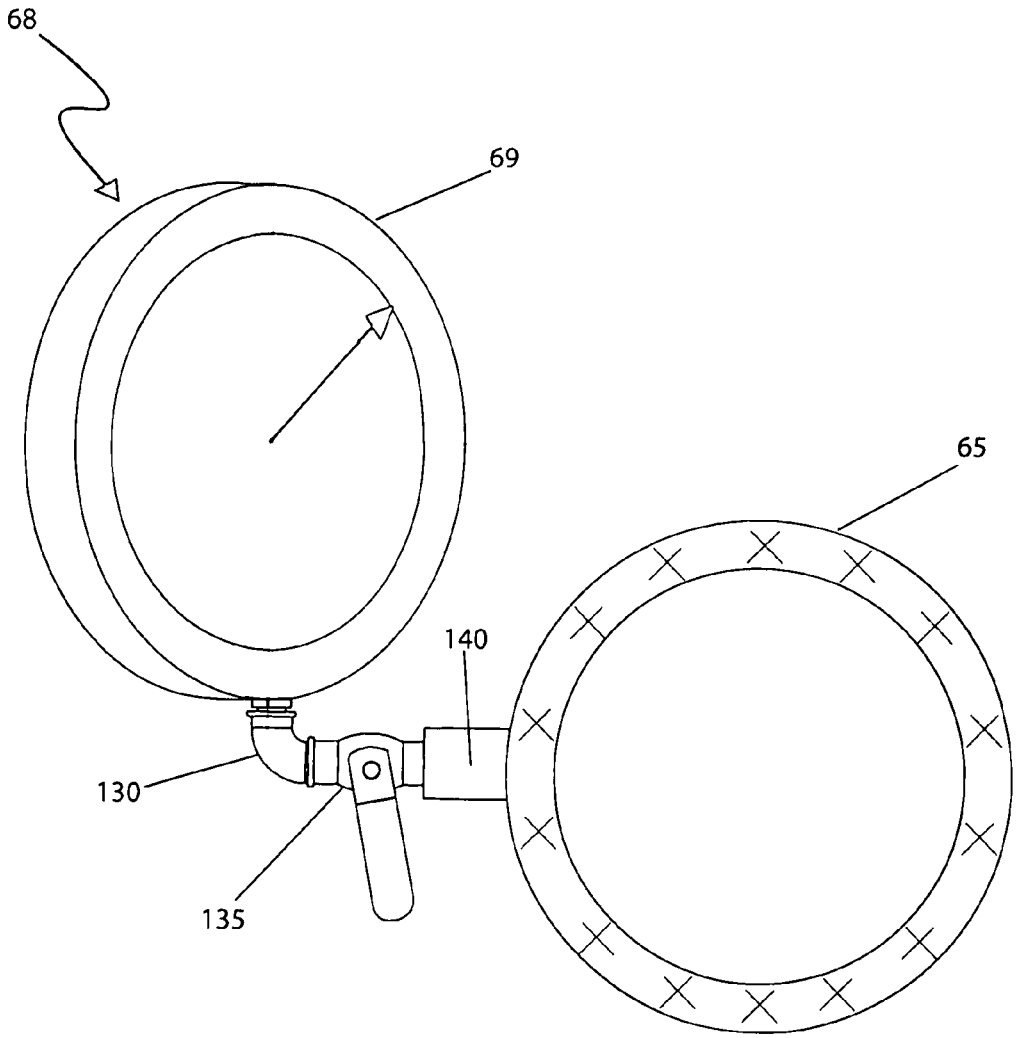
FIG. 4 is a pictorial representation of a pressure gage assembly 68 as used with the transportable and collapsible fabric tank system with integral balloon baffle system 10; and, FIG. 5 is a pictorial representation of a gate valve assembly 65 as used with the transportable and collapsible fabric tank system with integral balloon baffle system 10.

Referring now to FIG. 4, a pictorial representation of the pressure gage assembly 68 as used with the transportable and collapsible fabric tank system with integral balloon baffle system 10 is disclosed. The pressure gage assembly 68 comprises a common water pressure gauge 69 which is connected to the gate valve assembly 65 (shown here in a cross-section view) by way of an elbow 130, an isolation valve 135, and a pipe nipple 140. The pipe nipple 140 is envisioned to be welded to the side of the gate valve assembly 65. The isolation valve 135 allows isolation of the gate valve assembly 65 and maintenance of said pressure while the pressure gage assembly 68 is removed. Said removal would be necessary during transportation and storage to prevent physical damage to the pressure gauge assembly 68.

Figure 5:
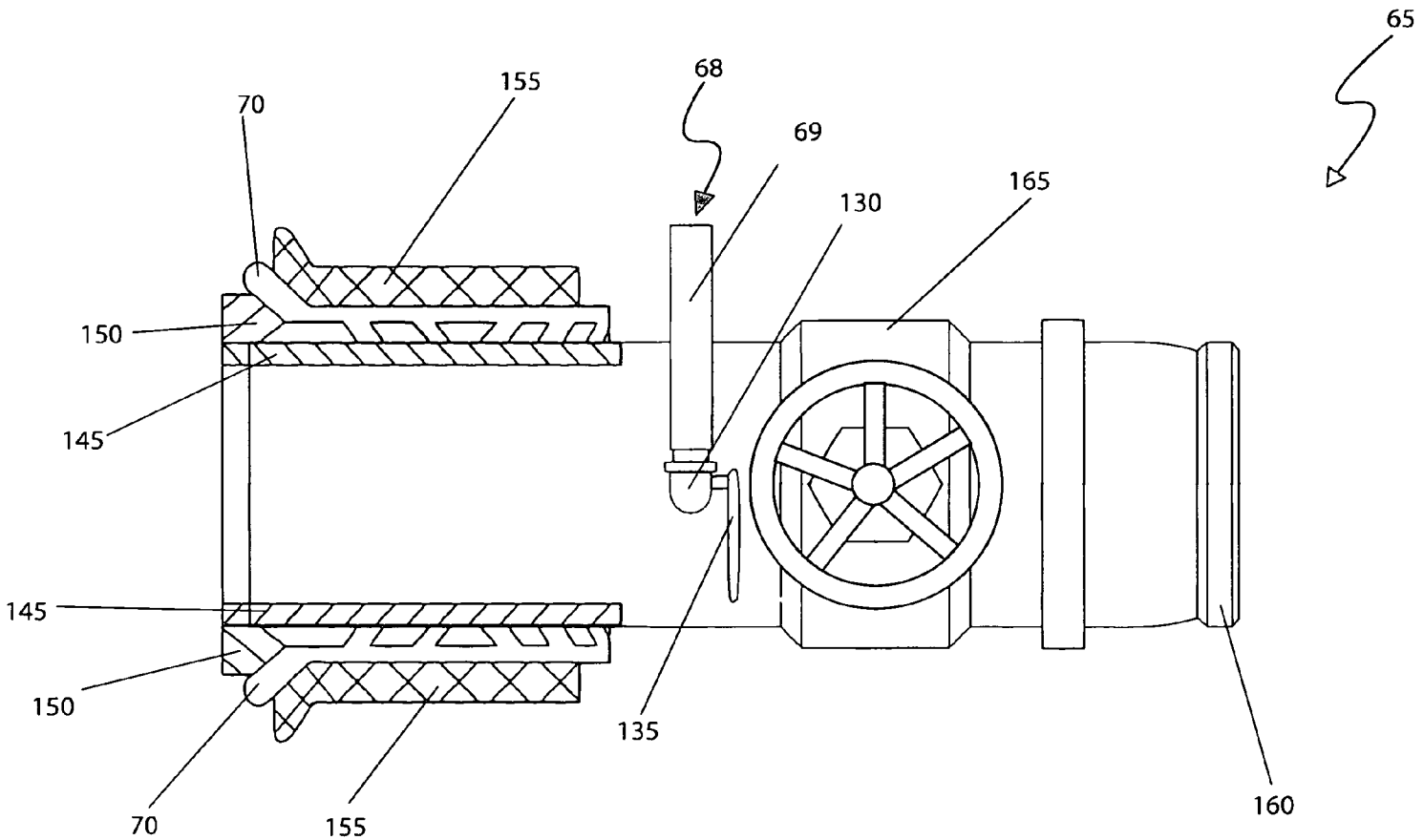

Referring finally to FIG. 5, a pictorial representation of a gate valve assembly 65 as used with the transportable and collapsible fabric tank system with integral balloon baffle system 10 is depicted. The gate valve assembly 65 is shown in a cutaway view for simplicity. A rubber adapter 145 is provided to ensure a tight and waterproof fit between the tank material 70 and an inside flange face 150 of the gate valve assembly 65. Said rubber adapter 145 functions as a gasket. A pipe clamp 155 is then placed around the tank material 70 and tightened to provide a mechanical and watertight seal. A hose adapter 160 is provided at the opposite end of the gate valve assembly 65 to allow the gate valve assembly 65 to connect to virtually any style of hose. It is envisioned that the transportable and collapsible fabric tank system with integral balloon baffle system 10 would be supplied with two (2) or more ten (10) foot lengths of hose with quick connect fittings in a conventional arrangement. The gate valve assembly 65 comprises a 4" gate valve 165 in its preferred arrangement, though virtually any type of valve could be used with equal effectiveness.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

When a new or used transportable and collapsible fabric tank system with integral balloon baffle system 10 is received by an organization it must be uncrated, installed and serviced. The user must ensure that all protruding nails and other objects are removed prior to attempting to remove the tank 70 from the packaging container. This is essential in order to avoid puncturing the tank 70.

Before placing the transportable and collapsible fabric tank system with integral balloon baffle system 10 on said truck transport system 15, the user would clear the truck transport system 15 of splinters, protruding nails and other foreign objects that could puncture or chafe the tank material 70. The user then places a protective bed cloth 85 on the truck transport system 15, rolls it forward and unrolls it rearward to a rear location. Next, the user would secure the transportable and collapsible fabric tank system with integral balloon baffle system 10 to the truck transport system 15 with the tie-down harnesses 80. There are two anchor points per belt to provide maximum support to the transportable and collapsible fabric tank system with integral balloon baffle system 10 during transport. Each anchor point is envisioned to consist of a ⅝" diameter eyebolt, two retaining plates, and accompanying hardware. The user would determine belt locations (depending on trailer type) and install said anchor assemblies and re-check the area for sharp objects. If the surface is rough and jagged, it will be necessary to place plywood or a tarpaulin down for the tank 70 to rest upon. Then the user would attach the ratchet take up mechanism 125 to each anchor point by using a shackle between the eyebolt and delta ring on the ratchet take-up mechanisms 125. Next, the user would lay the tie-down harnesses 80 crosswise to the length of the truck transport system 15, making sure the belts 120 are centered accurately between the eyebolt portion of said anchor points. The remaining portion of the belts 120 should lie over the side of the trailer 15. Care should be taken to insure that each belt 120 is not twisted and is laying flat. The area is now prepared for unfolding of the transportable and collapsible fabric tank system with integral balloon baffle system 10.

To install the transportable and collapsible fabric tank system with integral balloon baffle system 10 on the truck transport system 15, the user would use a lifting device, such as a forklift or crane, carefully taking hold of the sling 115 by its lift straps and placing the transportable and collapsible fabric tank system with integral balloon baffle system 10 on the truck transport system 15 in such a manner that the tank will unroll towards the front of the trailer. The ends of the transportable and collapsible fabric tank system with integral balloon baffle system 10 should be near or touching the trailer bulkhead. Next, the user would remove the belts 120 from the ratchet take-up mechanisms 125 and unroll and unfold the transportable and collapsible fabric tank system with integral balloon baffle system 10 over the belts 120 while visually inspecting tank. Then, the user positions the invention 10 so that when it is full, the ends or sidewalls will not rub against the forward bulkhead or hang over the sides of the truck transport system 15. Next the sling 115 would be removed from under the transportable and collapsible fabric tank system with integral balloon baffle system 10 and placed in the trailer stowage compartment. Before use, the transportable and collapsible fabric tank system with integral balloon baffle system 10 requires inspection. To perform said tasks, the user would inspect the tank material 70 for any punctures or tears. Also, the user would inspect the fittings and components for evidence of damage or missing bolts or gaskets.

Before use, the operator should be thoroughly familiar with the location and function of every control before operating the system. Other personnel comprising the crew should be thoroughly briefed in the operation of the system and be familiar with any shutdown or stopping procedures under emergency conditions. Said functional components include the gate valve assembly 65. Said valve in conjunction with any hoses, provides the connection necessary to both fill and empty the transportable and collapsible fabric tank system with integral balloon baffle system 10. The pressure gage assembly 68 envisioned to consist of a 0-15 PSI pressure gage is supplied to monitor the pressure of the filling transportable and collapsible fabric tank system with integral balloon baffle system 10. Operating pressure is 4 to 6 PSI. The pressure gage 69 is controlled by an isolation valve 135. The isolation valve 135 is to be closed when the pressure gage 69 is removed. The hose assembly could consist of two (2) or more ten (10) foot long by four (4) inch diameter hose (PTFE-coated for potable water, fuel, or any other FDA approved liquid) supplied with quick disconnect fittings. The pressure relief valve 75 is manually operated to relieve trapped air. Said pressure relief valve 75 is open and closed with finger pressure.

Along the driver's side of the tank 70 when fully unrolled, the three (3) balloon baffle air valves 110 are spaced approximately seven (7) feet apart from each other. These balloon baffle air valves 110 are the inlet/outlet valves for the three (3) respective balloon baffles 105 located inside the transportable and collapsible fabric tank system with integral balloon baffle system 10. The balloon baffles 105 are to be inflated before filling the transportable and collapsible fabric tank system with integral balloon baffle system 10 with any fluids. Inflation is accomplished by attaching any standard compressed air hose, such as from the trailer, to the balloon baffle air valves 110 to inflate the balloon baffles 105 to an operating pressure between 4 to 6 PSI. The balloon baffles 105 may be deflated by pressing down on the center pin of the balloon baffle air valves 110, thus allowing air to escape the balloon baffles 105. The balloon baffles 105 can be further deflated as the transportable and collapsible fabric tank system with integral balloon baffle system 10 is rolled up.

Before filling the invention 10 with a fluid, the user would check to see that the transportable and collapsible fabric tank system with integral balloon baffle system 10 is properly installed. The truck transport system 15 should be level to prevent the tank 70 from rolling from side to side. Tighten all the cap screws 55 to 70±5 ft. lbs. of torque on the left hand top end clamp 30, the left hand bottom end clamp 35, the right hand top end clamp 40 and the right hand bottom end clamp 45. The PTFE in a new transportable and collapsible fabric tank system with integral balloon baffle system 10 will "cold flow" under the pressure and the cap screw torque 55 will drop. Said cap screws 55 should be re-torqued periodically until the rubber adapter 145 has set and the torque doesn't drop appreciably. If leakage is noted at the fittings or if the tank 70 is subjected to hard usage, the cap screws 55 should be re tightened periodically. Next, the user would attach the pressure gage assembly 68 to the gate valve assembly 65 and then open the isolation valve 135.

Before using the transportable and collapsible fabric tank system with integral balloon baffle system 10 for the first time or after prolonged storage, flush the tank with 100 to 300 gallons of clean disinfectant and water solution. The solution could consist of ½ gallon of commercial bleach mixed in 250 gallons of fresh water. Then, the user surges the cleansing solution by walking back and forth on the transportable and collapsible fabric tank system with integral balloon baffle system 10 or by rocking the truck transport system 15 with abrupt starts and stops. The resultant surge will clean the collapsed transportable and collapsible fabric tank system with integral balloon baffle system 10 without exposing its interior to contaminants or foreign objects. Rinse transportable and collapsible fabric tank system with integral balloon baffle system 10 with 250 gallons water to remove bleach taste. When the cleaning is complete, close the gate valve assembly 65 immediately to hermetically seal out contaminants.

Before starting to fill the transportable and collapsible fabric tank system with integral balloon baffle system 10, ensure that all air has been expelled. Then close the gate valve assembly 65. Also ensure that the balloon baffles 105 are fully inflated. The user then attaches a source of water or other liquid to a user supplied hose, purges the air from the filling line and the hose by opening the valve at the water source until the water comes out the supplied hose, and turns off water at the water source. Next, the free ends of the tie-down harnesses 80 should be brought over the top of the transportable and collapsible fabric tank system with integral balloon baffle system 10 and down the other side through the ratchet take-up mechanisms 125 attached to the truck transport system 15. The user slides the ends of the belts 120 two feet through slot in the ratchet take-up mechanisms 125 and folds end back on belts 120 and hold manually until one turn has been taken on roll up spool portion of said ratchet take-up mechanisms 125.

Next, the user would attach the user supplied hose to the gate valve assembly 65 and opens the valve at the potable water supply, or other fluid source and opens the gate valve 165 on the transportable and collapsible fabric tank system with integral balloon baffle system 10. No pressure will show on the pressure gage assembly 68 until the transportable and collapsible fabric tank system with integral balloon baffle system 10 is approximately two (2) feet high. From that point on, periodically check the exact pressure by closing the gate valve 165 on the transportable and collapsible fabric tank system with integral balloon baffle system 10 to obtain a precise pressure reading. After a pressure reading has been taken, the user opens the gate valve 165 again on the transportable and collapsible fabric tank system with integral balloon baffle system 10 and resumes filling to 2 to 3 PSIG. The user then opens the pressure relief valve 75 on the top of the transportable and collapsible fabric tank system with integral balloon baffle system 10 until water flows from the pressure relief valve 75. The belts 120 should now be tightened with the ratchet take-up mechanisms 125 to the maximum possible with one hand on the ratchet take-up mechanisms 125. The second hand should be used to steady the ratchet take-up mechanisms 125 so that the belts 120 will wind flat and true. After tightening each of the four ratchet take-up mechanisms 125, see that the ratchet handle has dropped securely into the locking mechanism portion of the ratchet take-up mechanism 125. When all ratchet take-up mechanisms 125 have been tightened uniformly, the pressure in the transportable and collapsible fabric tank system with integral balloon baffle system 10 will be increased approximately 2 PSI. NOTE: If the transportable and collapsible fabric tank system with integral balloon baffle system 10 end portions are not level with the floor of the truck transport system 15, the transportable and collapsible fabric tank system with integral balloon baffle system 10 may be leveled by releasing the ratchet take-up mechanisms 125 on one side of the transportable and collapsible fabric tank system with integral balloon baffle system 10 and then taking up the slack by tightening the opposing ratchet take-up mechanisms 125. After filling the transportable and collapsible fabric tank system with integral balloon baffle system 10 to a correct pressure of four (4) to six (6) PSI, shut off filling line valve first, shut off the gate valve 165 and then disconnect filling line. Some loss of liquid between the valves will be experienced at this point. Material is under pressure between the valves. Said pressure is envisioned to be low if the filling line valve is shut off first as directed above, and high if the gate valve 165 is shut off first. NOTE: The closed system of filling a transportable and collapsible fabric tank system with integral balloon baffle system 10 allows the pressure to build up very rapidly as the transportable and collapsible fabric tank system with integral balloon baffle system 10 reaches full capacity. It is recommended that the transportable and collapsible fabric tank system with integral balloon baffle system 10 be filled to a final minimum pressure of four (4) PSI and a maximum of six (6) PSI, keeping the isolation valve 135 open to allow continual observation of tank pressure. The transportable and collapsible fabric tank system with integral balloon baffle system 10 is now properly filled and secured for transportation. Regular periodic checks for tightness of belts 120 are required.

To drain the transportable and collapsible fabric tank system with integral balloon baffle system 10, the user would perform the procedure described hereinbelow. It must be noted that transportable and collapsible fabric tank system with integral balloon baffle system 10 is designed to be emptied by gravity or suction pump only. Use of air pressure to unload tank should not be used as it may cause the transportable and collapsible fabric tank system with integral balloon baffle system 10 to burst under pressure, except when inflating balloon baffles 105 fully to force fluids out of the tank through the discharge valve by displacing fluid with air. The transportable and collapsible fabric tank system with integral balloon baffle system 10 can be drained either by gravity or by the use of a pump. To drain by gravity, the user would ensure that the end of the transportable and collapsible fabric tank system with integral balloon baffle system 10 opposite the gate valve assembly 65 must be at least 8" to 10" higher than the end of the transportable and collapsible fabric tank system with integral balloon baffle system 10 with the gate valve assembly 65. The corner of the belts 120 with the gate valve assembly 65 should be the lowest level of the transportable and collapsible fabric tank system with integral balloon baffle system 10. The proper use of grade elevation or portable ramps under the appropriate trailer wheels 15 is paramount. The user would connect one end of the user supplied hose to the hose adapter 160, while the other end of the hose to the line or container requiring the potable water. Next, the user would open the gate valve 165 on the tank to start the flow. After operation is complete, close gate valve 165 on end of transportable and collapsible fabric tank system with integral balloon baffle system 10.

To drain by pump, the user would connect one end of a user supplied hose to the gate valve assembly 65 and connect the other end of the user supplied hose to the pump. Next, the isolation valve 135 would be closed, and the gate valve 165 would be opened. In the next step the user would start the pump, while noting that the draining rate is not a factor in tank operations. After operation is complete, the gate valve 165 would be closed, along with the valve on the pump. Next, the user supplied hose assembly from the line, container or vacuum pump would be disconnected, whichever is applicable. Then the user would disconnect said hose from hose adapter 160 and close the isolation valve 135.

To repackage the transportable and collapsible fabric tank system with integral balloon baffle system 10 after use, the user would remove the pressure gage assembly 68, deflate all balloon baffles 105 and disconnect all tie-down harnesses 80 and remove. Hang loose ends of belts 120 over sides of truck transport system 15. Then the user would fold the transportable and collapsible fabric tank system with integral balloon baffle system 10 almost in half lengthwise, by laying the top fold of the transportable and collapsible fabric tank system with integral balloon baffle system 10 down approximately one (1) foot shorter than the bottom fold. The ends will then be equal when the transportable and collapsible fabric tank system with integral balloon baffle system 10 is rolled up. The user would then manually roll the transportable and collapsible fabric tank system with integral balloon baffle system 10 into a cylinder shape. It is necessary that the first roll be circular and tight, otherwise the transportable and collapsible fabric tank system with integral balloon baffle system 10 will be hard to roll and will make a large package. If the transportable and collapsible fabric tank system with integral balloon baffle system 10 is to be transported to a new location or placed back in its shipping box, the sling 115 may be slipped around and under the transportable and collapsible fabric tank system with integral balloon baffle system 10. The user would also roll and store belts 120, the pressure gage assembly 68, the ratchet take-up mechanisms 125, etc. in a prepared area, preferably in a box. It should be ensured that the pressure gage assembly 68 be packed in suitable padding to avoid damage. After the first few uses, the transportable and collapsible fabric tank system with integral balloon baffle system 10 will become more flexible and easier to roll and unroll.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A fluid containment apparatus comprised of a textile-based composite material and consisting of internal baffles, further comprising:

a fabric tank for receiving and storing a fluid for subsequent transportation;

at least one baffle situated within said fabric tank for reducing a sloshing effect of a partially filled tank thus ensuring safe transport;

at least one baffle valve in fluid connection therewith said baffle for receiving air pressure from an external source and directing said air pressure thereto said baffle;

a clamp top further comprising:

a set of hand grips to aid in movement and placement of said tank when empty;

a right hand top end clamp;

a left hand top end clamp; and, a clamp bottom further comprising:

a right hand bottom end clamp;

a left hand bottom end; and, a valve assembly through which said fluid is introduced and dispensed therethrough, said valve assembly further comprising a control assembly;

wherein fastening of said clamp top and clamp bottom is aided by a plurality of fastening elements;

wherein said baffle provides said tank with an overall shape and provides added stability.

2. The tank of claim 1, further comprising a rectangular shape footprint allowing for attachment to a hauling or towing vehicle.

3. The tank of claim 2, wherein said fabric tank collapses to a contained water level which reduces gas build-up and further enhances vehicle stability.

4. The tank of claim 3, wherein said fabric tank further comprises safety features comprising:

a plurality of tie-down harnesses for preventing said tank from lateral movement during transportation;

a ratcheting mechanism for operating said tie-down harnesses; and, a protective bed cloth for protecting said tank from any physical abnormalities present on the bed of said towing vehicle, thereby helping to avoid possible punctures.

5. The tank of claim 4, wherein said tank may be rolled and tied for storage which also provides said hauling or towing vehicle with additional hauling capacity after said fluid has been dispensed therefrom said fabric tank.

6. The tank of claim 5, further comprising a standard four-inch hose connector for attachment thereto said tank.

7. The tank of claim 6, wherein said fabric tank further comprises a reinforced bed layer to reduce a chance of punctures.

8. The tank of claim 7, further comprising an integral pressure gage assembly to indicate and control internal pressure build-up within said tank.

9. The tank of claim 8, further comprising an on-board conventional air compressor releaseably connected thereto said fabric tank to inflate or deflate said baffle.

10. The tank of claim 9, wherein said valve assembly is a four-inch gate valve.

11. The tank of claim 10, wherein said valve assembly further comprises:

an inside flange face and an inlet end;

a rubber adapter placed between said tank and said inside flange face and functions as a gasket;

a pipe clamp is then placed around said first end of said tank and tightened to provide a mechanical and watertight seal; and, a hose adapter is provided at an outlet end of said gate valve assembly to allow said valve assembly to connect to external distribution piping.

12. The tank of claim 1 wherein said fabric tank has at least one area where identification labels, instructions, or other safety indicia can be placed or replaced as necessary and attached thereto.

13. The tank of claim 12, wherein said fabric tank comprises any color or design, including camouflage.

14. The tank of claim 13, wherein said fabric tank has a weight less than a conventional stainless steel tank of similar dimensions.

15. The tank of claim 14, further comprising a relief valve for providing a means to bleed off vapors and gases attachable thereto said tank; wherein said relief valve further provides stabilization during transportation when said tank is partially filled.

16. The tank of claim 15, wherein said fabric tank comprises three baffles inflated via three air valves.

17. The tank of claim 16, wherein said tank comprises a deflated state of dimensions comprising approximately 28' long by 7'4" wide by 4" high and a fully inflated state of dimensions comprising approximately 27' long by 5'2" wide by 4'6" high and is capable of holding approximately 3,000 gallons.

18. The tank of claim 17, further comprising at least two lengths of hose, preferably ten (10) feet in length with quick connect fittings in a conventional arrangement.

19. The tank of claim 18, further comprising an inlet and an outlet connector each in fluid connection therewith external distribution piping at second ends and thereto said portable, flexible and transportable tank system at first ends.

20. The tank of claim 19, further comprising a heavy textile-based bladder either coated thereon or impregnated or both therewith a flexible material, such as PTFE.

* * * * *